United States Patent [19]

Hulek

[11] Patent Number: 4,953,615

[45] Date of Patent: Sep. 4, 1990

[54] PLANT FOR THE CONTINUOUS CASTING OF STEEL

[76] Inventor: Anton Hulek, Goglerfeldgasse 15, A - 4020 Linz, Austria

[21] Appl. No.: 301,315

[22] Filed: Jan. 24, 1989

[30] Foreign Application Priority Data

Feb. 1, 1988 [AT] Austria ..... 193/88

[51] Int. Cl.[5] ..... B22D 11/00

[52] U.S. Cl. ..... 164/417; 164/418

[58] Field of Search ..... 164/417, 418, 459, 476, 164/430, 431, 432, 481; 29/527.5, 527.7

[56] References Cited

U.S. PATENT DOCUMENTS 4,519,439 5/1985 Fredriksson et al. ..... 164/476

4,716,955 6/1988 Fastert ..... 164/476

4,811,779 3/1989 Streubel ..... 164/459

*Primary Examiner*—Richard K. Seidel

*Attorney, Agent, or Firm*—Kurt Kelman

[57] ABSTRACT

In a process for the continuous casting of steel, molten steel is vertically cast in mold means to form a strand having an elongate shape in cross-section and is caused to solidify as it flows through the mold means. To permit a thin strand to be efficiently produced, the strand is first cooled while a constant cross-section is maintained, that cooling is continued until a strong shell which has entirely been solidified at least in the narrow side walls has been formed, and the cooling and solidification of the strand are subsequently continued while the strand is progressively deformed and compacted to form a flat preliminary strip.

10 Claims, 3 Drawing Sheets

PLANT FOR THE CONTINUOUS CASTING OF STEEL

BACKGROUND OF THE INVENTION

1. Field of the Invention

This invention relates to a plant for the continuous casting of steel, wherein molten steel is vertically cast in mold means to form a strand having an elongate shape in cross-section and is caused to solidify as it flows through the mold means 2. Description of the Prior Art In the conventional continuous casting processes using stationary molds, only low casting speeds of about 1.5 to 5 meters per minute can be achieved and only relatively short molds having a length of about 900 mm can be used because heat must be dissipated at a high rate through the mold so that an intense contact between the strand and the mold will be required, on the one hand, and because optimum friction conditions must be ensured owing to the sliding movement of the strand within the mold and the fact that the strand shell still has only a low strength. To achieve economically satisfactory casting rates in spite of such rather restricting requirements, the strands must have a large thickness, e.g., of 210 mm. For this reason the slabs or blooms produced by such continuous casting processes must greatly be reduced in cross-section during their subsequent further processing to produce a broad strip having a thickness of only a few millimeters and expensive plants are required for that purpose. Known traveling molds in which a relative movement between the strand and the mold wall is avoided permit a higher casting speed than stationary molds so that a given casting rate can be achieved with strands having a reduced thickness down to about 100 to 150 mm. But the dimensions of conventional pouring pipes require the mold to have a sufficiently large entrance cross-section and do not permit a casting of strands having a smaller thickness without the use of a reducing mold. For this reason even the slabs which can be produced by means of a traveling mold having a constant cavity cross-section are too thick and a more effective rationalization of the further processing is prevented.

Stationary molds having a reducing cavity have also been provided in order to make thin slabs but the small entrance cross-section requires the use of special pouring funnels and the strand leaving the mold has only a thin shell, which must be supported and cooled by special means. Besides, that mold does not permit casting speeds to be achieved which would permit an immediate feeding of the thin slabs to a rolling mill train.

It has been proposed to provide for a continuous casting of flat slabs having a thickness of about 50 mm a reducing mold which consists of a traveling plate mold consisting of converging plate chains so that the strand is reduced in cross-section from a large entrance cross-section conforming to the dimensions of the casting pipe to a correspondingly smaller exit cross-section as the strand passes through the mold. Whereas that reducing mold can be used to make relatively thin slabs under conventional casting conditions, the casting speeds which can be achieved are too low for an immediate feeding of the slabs to a rolling plant. This is due to mechanical and metallurgical reasons. Besides, a wear will occur at the displaceable plate elements so that trouble is likely to arise, the sealing of the mold cavity is difficult, the mold must meet high requirements and it is doubtful whether the simultaneous solidification and deformation of the strand will not result in metallurgical faults.

SUMMARY OF THE INVENTION

For this reason it is an object of the invention to eliminate the disadvantages outlined hereinbefore and to provide a continuous casting plant which is of the kind described first hereinbefore and which ensures a particularly economical casting of a thin slab which is suitable for a direct further processing, which is inexpensive and is reliable in operation.

This object is accomplished in accordance with the invention with a continuous casting plant having a first stage comprising a mold defining a molding cavity of a constant cross-section of flat parallelogram shape, and a second stage succeeding the first stage and comprising deforming means defining a molding cavity having an entrance of substantially the same cross-section as the first-stage mold, the molding cavity of the deforming means tapering toward an exit thereof in the smaller dimension of its parallelogram cross-section to be of flat planoparallel shape. A strand of cast molten metal is maintained, that cooling is continued until a strong shell which has entirely been solidified at least in the narrow side walls has been formed, and the cooling and solidification of the strand are subsequently continued while the strand is progressively deformed and compacted to form a flat preliminary strip. For this reason the strand can be cast to have a sufficiently large cross-section, e.g., a thickness of about 150 mm, and will remain undeformed until a sufficiently strong and load-resisting shell had properly been formed. As a result, the casting process, the initial solidification and the initial formation of the shell can proceed without any disturbance. Only when a sufficiently thick shell has been formed so that particularly a lateral rupture of the strand will be precluded will the strand be deformed to form the desired flat preliminary strip. The deformation will not require a lateral guidance of the strand and it will be sufficient to spread the strand by equal distances in opposite directions so as to form the desired striplike initial product. The strand completely solidifies as it is deformed and the compaction resulting in the flat preliminary strip will ensure that the shell halves lying one on the other will finally be welded together. Strips having a thickness up to about 20 mm can be produced without difficulty at casting speeds of 27 to 37 meters per minute so that the preliminary strip can be fed immediately and at an adequate rate to a rolling mill train, in which only three rolling mill stands are required to make a broad strip.

The strand which is cast in the practice of the invention has the configuration of a parallelogram in cross-section so that the strand will be deformed and compacted in the direction of its smaller dimension of its cross-section. Such a cross-section having the configuration of a parallelogram will have a central region which is sufficiently large for the use of conventional pouring pipes and its side extend along the longer diagonal taper is a small thickness so that the formation of a shell which has ben solidified throughout its thickness will be promoted. Besides, such a strand having the configuration of a parallelogram in cross-section can be compacted to form a planoparallel strip without a need for an excessively large deformation.

The described and illustrated deforming means is a second mold having the tapering cavity cross-section. Said two molds constitute separate devices for carrying out the process steps, in which the strand is formed and deformed, respectively, so that each mold can specifically be designed with a view to the requirements for the step to be performed therein.

In a particularly desirable embodiment of the invention the first mold consist of a traveling plate mold, which is known per se and consists of a pair of opposite, revolving endless plate chains, which define the mold cavity between them, and the second mold is stationary and has well portions which constitute continuations of the plate chains and define a mold cavity between them and are pivoted on respective transverse apex disposed in the entrance region of the second mold. The mold cavity of the second mold changes from an entrance cross-section, which corresponds to the exit cross-section of the first mold, to a flat planoparallel exit cross-section. The traveling first mold may have any desired length, which may be determined in dependence on the speed of the strand in said first mold and on the solidification rate and may have a length of, e.g., 3000 mm so that a shell having a thickness of 10 mm can be obtained at the exit of the first mold if the casting speed is, e.g., 27 m/min. The traveling plate chains do not involve sliding friction and the high ferrostatic pressure provides favorable conditions for the heat transfer between the strand and the first mold. As a result, the shell will reliably have the required thickness in spite of the high casting speed. The strand which has left the traveling plate mold is then received by the reducing stationary mold, which has properly adjusted wall portions for reducing the cross-section of the strand as required. As said wall portions are pivotally adjustable, the stationary second mold can be opened at the beginning of the casting operation in order to avoid disturbances during the movement of the starter strip through the second mold. Thereafter the wall portions are moved to the desired reducing position in contact with the strand by means of actuators. The reducing second mold need not be laterally closed and involves a relatively low structural expenditure. The strand leaving the reducing second mold consists of a flat preliminary strip having a thickness of about 20 mm and moving at a speed of 27 to 30 m/min so that said preliminary strip can immediately be fed to a rolling mill train for a first pass in view of the thickness and the exit speed of said preliminary strip. Besides, the casting rate which can thus be achieved is consistent with the production rate of a broad-strip rolling mill train so that such a broad-strip rolling mill train may be supplied by a single continuous casting plant in accordance with the invention whereas two continuous slab-casting plants were previously required for that purpose.

Particularly good conditions for carrying out the continuous casting process will be obtained within the scope of the invention, if the mold cavity of the first mold is defined by the inside surfaces of said plates, two corresponding plates of the two plate chains may constitute a pair of plates extending at an angle to each other and defining a parallelogram in cross-section, each plate of each pair has at one end an edge rib, which abuts the inside surface of the other plate of the same pair, and each wall portion of the stationary second mold is composed of a plurality of longitudinal beams, which are connected to respective actuators, preferably hydraulic actuators. The plate chains impart to the cast strand a cross-sectional shape which has the configuration of a parallelogram and which at its small sides, where the edge ribs are provided, has a dimension which corresponds to the desired thickness of the preliminary strip so that the strand can easily be deformed to form a flat preliminary strip. The plates of each pair can also be adjusted transversely to the direction in which the strand moves through the second mold so that the cross-sectional dimensions can be changed. Because each wall portion of the stationary second mold is composed of separate longitudinal beams said wall portions can be exactly adapted to the desired cross-sectional shape of the strand. Besides, the strand moving through the second mold is deformed in strip-shape areas by the several beams so that the desired reduction in cross-section can be effected with a minimum structural expenditure.

If each beam is provided with longitudinally aligned rollers and the rollers on adjacent beams are staggered, the frictional conditions in the reducing mold will be improved and the overlapping staggered roller will ensure a proper deformation of the strand.

The rollers should be adaptable to various strand cross-sections and particularly to the progress of the deformation of the strand. For that purpose the rollers are mounted on the beam in adjustable bearing brackets and the height and inclination of the axis of rotation of the rollers may be changed by the provision of shims between said bearing brackets and the beams.

Nozzles for discharging a coolant may be provided between the beams and the rollers. In that case the cooling and solidification of the strand moving through the second mold may be controlled and may possibly be adapted to the progress of the deformation.

Owing to the space requirement of the molds there will be a free space between the first and second molds. In accordance with a further feature of the invention a strand guide may be provided, which bridges said free space and which preferably consists of two shell sections and is provided with rollers and cooling slots. By that strand guide the strand which has left the traveling mold is supported and is reliably transferred to the stationary second mold so that trouble cannot arise in the region and a formation of cracks in the shell of the strand will be prevented. The strand guide has a constant cross-section and is preferably composed of two parts to facilitate its assembling and maintenance and may be provided with rollers and cooling slots in order to improve the frictional and cooling conditions.

In order to ensure that the preliminary strip leaving the continuous casting plant will have a uniform thickness and sound structure, the second mold is succeeded within the scope of the invention by a pair of transversely extending squeeze rolls, which join by pressure welding the core portions and compacted shell portions which have solidified during the deformation and in which a more uniform structure is thus established.

DETAILED DESCRIPTION OF THE PREFERRED EMBODIMENT

Figure 1:
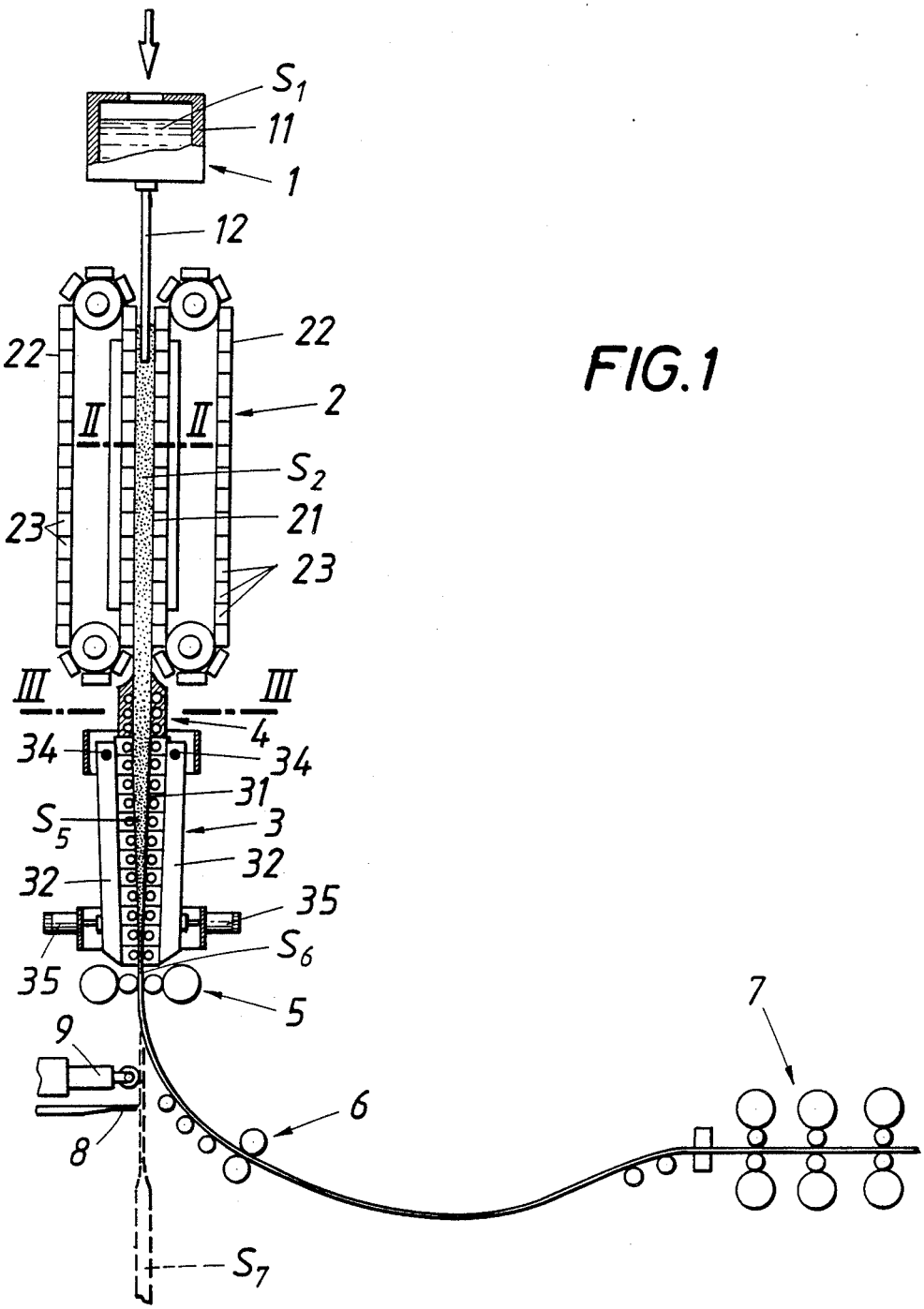
FIG. 1 is a layout diagram showing the continuous casting plant in accordance with the invention.

An illustrative embodiment of the invention will now be described more in detail with reference to the drawing.

Figure 2:
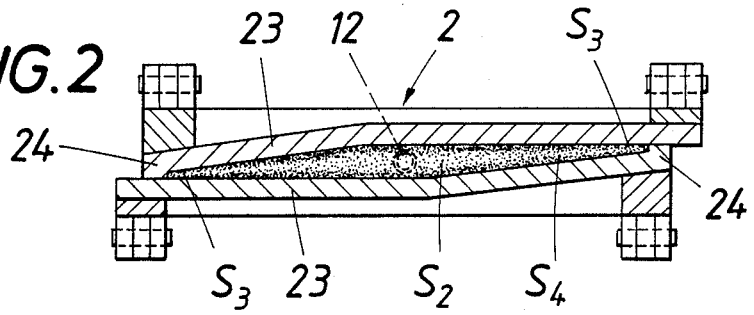
FIG. 2 is an enlarged sectional view taken on line II—II in FIG. 1 and showing the first mold of the plant of FIG. 1.

The illustrated continuous casting plant for an efficient production of a flat preliminary strip comprises a pouring apparatus 1, a first mold 2, a second mold 3 succeeding the first mold, a strand guide 4 disposed between the molds and a pair of squeeze rolls 5, which closely succeed the second mold 3. The pouring apparatus 1 consists of a supply vessel 11 for holding molten steel $S_1$ and a pouring pipe 12 for charging the molten steel $S_1$ into the mold cavity 21 of the first mold 2. The first mold 2 is a traveling plate mold consisting of a pair of opposite revolving endless plate chains 22, which define the mold cavity 21, which is uniform in cross-section. The plate mold 2 is of conventional type. As shown is FIG. 2, the plates 23 of the two plate chains 22 constitute pairs of mirror-symmetrically arranged plates which consist of two parts extending they define a parallelogram in cross-section. Each plate 23 is integral and is provided at one end with an edge rib 24, which abuts the other plate of the same pair on its inside surface, which defines the mold cavity 21 (FIG. 2). Such a plate mold is structurally simple, stable, reliable in operation and not susceptible to trouble. Because the plate chains 22 can transversely be displaced relative to each other the width of said mold can be adapted to different cross-sectional dimensions.

In the first mold 2 the molten steel $S_1$ is cast to form a strand $S_2$, which has a uniform cross-section having approximately the configuration of a parallelogram. That strand is cooled as it moved through traveling plate mold 2 and the strand leaving mold 2 has a strong shell, which has entirely been solidified at least at the narrow side faces $S_3$. The mold cavity 21 is so large that the pouring pipe 12 can be inserted into the mold cavity 21 to extend below the level of the molten steel in the mold cavity 21. The traveling mold 2 ensures optimum frictional conditions in conjunction with an intense contact between the strand and the mold so that heat will be dissipated at a high rate, high casting rates under proper casting conditions can be achieved and such a length may be selected for the mold that a shell having the desired thickness will readily be formed at the prevailing solidification rates.

Figure 3:
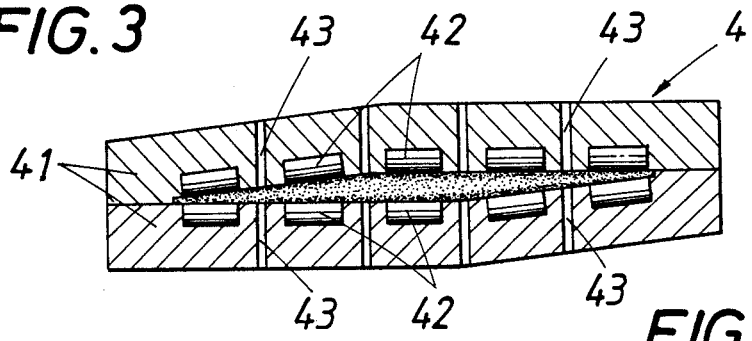
FIG. 3 is an enlarged sectional view taken on line III—III in FIG. 1 and showing the strand guide of the plant of FIG. 1.

The strand $S_2$ which has left the first mold 2 enters the second mold 3. The strand guide 4 ensures a functionally reliable, undisturbed transfer of the strand from the first mold to the second. To simplify the assembling and maintenance of the strand guide 4 the latter is composed of two half-shells 41, which define a constant guide cross-section, which corresponds to the exit cross-section of the mold 2 (See FIG. 3). The frictional conditions in the strand guide 4 may be improved by the portion of rollers 42 mounted in the half-shells 41 and the latter may be provided in a suitable distribution with cooling slots 43 for a proper dissipation of heat and cooling of the strand.

Figure 6:
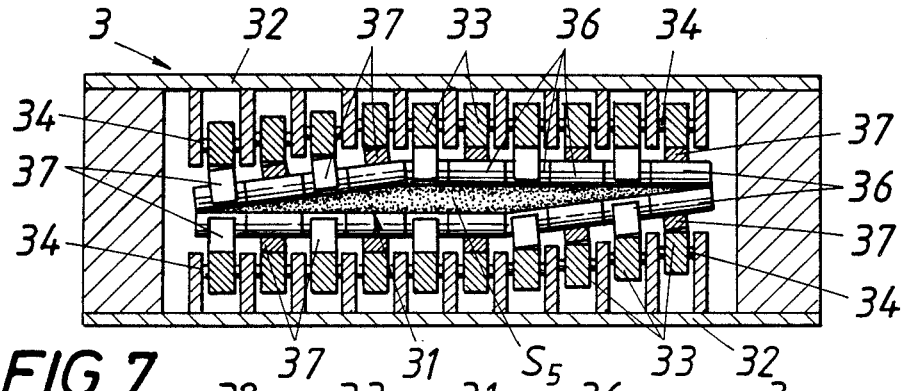
FIGS. 6 and 7 are transverse sectional views taken on lines VI—VI and VII—VII, respectively, in FIG. 4.
Figure 7:
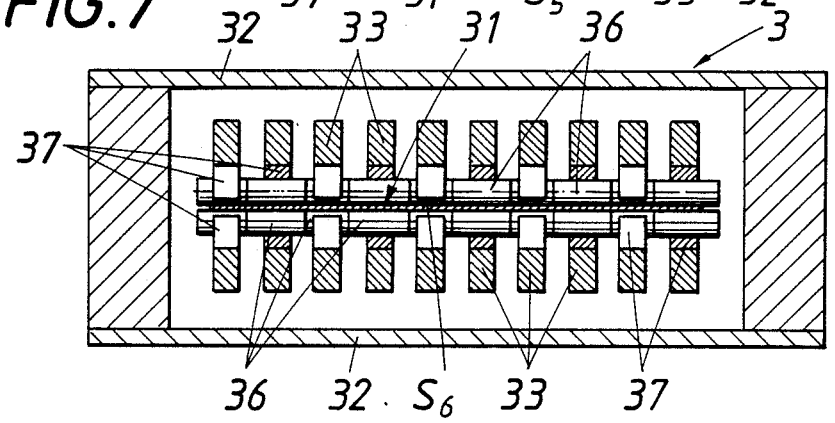
Figure 4:
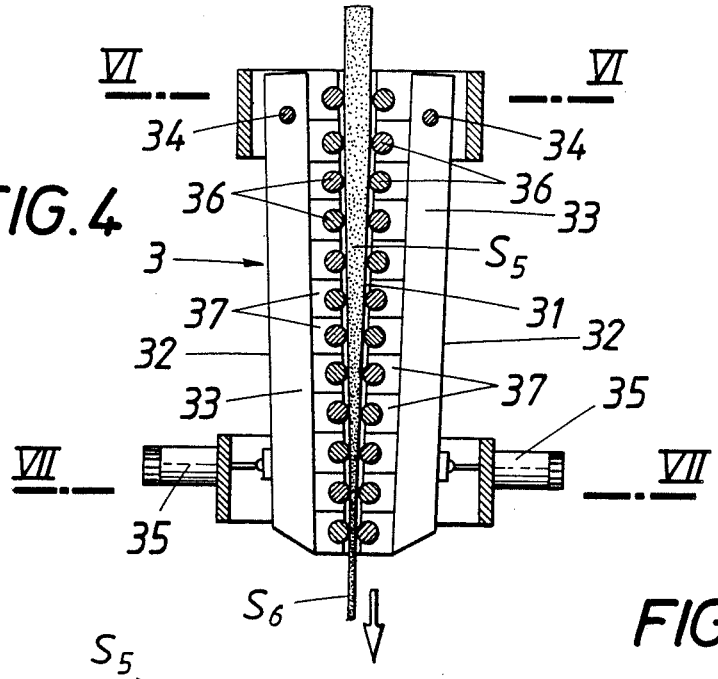
FIGS. 4 and 5 are, respectively, a longitudinal sectional and a top showing on a larger scale the second mold of the continuous casting plant of FIG. 1.
Figure 5:
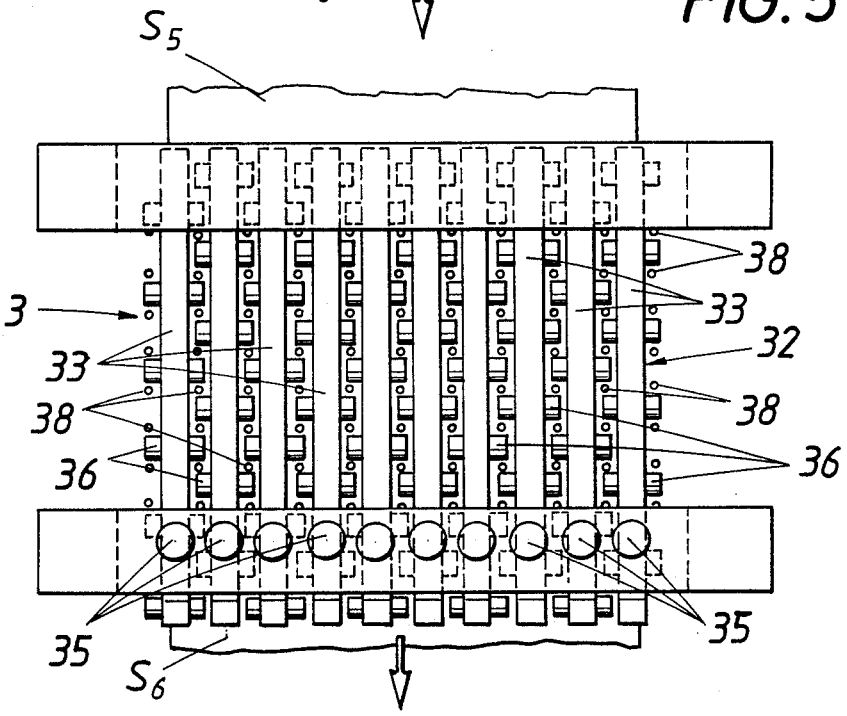

The strand guide 4 is succeeded by the second mold, 3, which contrary to the first mold 2 consists of a stationary mold having a tapering mold cavity 31. That mold cavity 31 is defined by two wall portions 32, each of which is composed of a plurality of separate longitudinal beams 33 (See FIGS. 4–7). Each longitudinal beam 33 is pivoted on a transverse pivot 34, which is disposed at the entrance of the second mold 3. Each longitudinal beam 33 is supported by an actuator 35 for pivotally adjusting the longitudinal beam. The beams 33 may be adjusted to define a mold cavity 31 which changes from a parallelogram-shaped entrance cross-section (FIG. 6) corresponding to the guide cross-section of the strand guide (4) to a flat parallelogram-shaped exit cross-section (FIG. 7). As a result, the strand $S_5$ moving through the stationary mold 2 is progressively deformed from a parallelogram-shaped cross-section to a flat preliminary strip $S_6$ and is compacted.

In order to reduce the friction the beams 33 are provided with successive alined rollers 36. The rollers 36 provided on adjacent beams 33 are staggered to overlap each other. For an adaptation of the positions of the roller 36 to the progress of the deformation and to the adjacent cross-section of the strand, the rollers 36 are mounted on adjustable bearing brackets 37 so that the transition from the parallelogram-shaped cross-section to the flat cross-section will be as smooth as possible. Nozzles 38 for discharging a coolant are provided between the beams 33 and the rollers 36 so that the heat dissipation and the solidification rate of the strand moving through the mold 3 can be controlled.

Because the strand $S_5$ entering the second mold 3 has already a strong shell $S_4$, which has entirely been solidified at its narrow sides, the reducing mold 3 need not be provided with lateral confining walls and the opposite wall portions 32 are sufficient for defining the reducing mold cavity 31.

The compacted flat preliminary strip $S_6$ which has left the second mold is passed between squeeze rolls 5, which ensure that the preliminary strip will have a compacted structure and which effect a pressure welding by which the shell portions forced against each other will be joined.

The preliminary strip $S_6$ has a sufficiently thin cross-section and exits from the continuous casting plant at an adequate speed. It is deflected by guiding and backing rollers 6 and can immediately be delivered to a rolling mill train 7. It will be understood that the required directing and straightening and control means, not shown, must be provided.

To initiate the operation of the continuous casting plant the reducing second mold 3 is opened in order to avoid trouble as the starter strip moves through the tapering mold cavity 31. When the starter strip has moved through the mold 3, the actuators 35 for the beams 33 are operated to impart to the mold cavity 31 such a shape that the desired reduction in cross-section will be effected. The starter strip $S_7$ is severed as starting scarp from the preliminary strip $S_6$ by suitable shears 8 and the preliminary strip is then acted upon by a straightening ram 9 and for being properly withdrawn is delivered to the deflecting and backing rollers 6 so that the fact that the cross-section is not reduced at the beginning of the casting operation will not be significant.

I claim:

1. A plant for the continuous casting of molten steel into a strand of a flat planoparallel cross-section, which comprises (a) a first stage comprising a mold defining a mold cavity of a constant cross-section of flat parallelogram shape, the mold having means for cooling the molten steel as it moves downwardly through the mold cavity until a strand of steel having a solid shell has been formed therein and the steel has been entirely solidified at the narrow sides thereof, and (b) a second stage succeeding the first stage and comprising a second, separate strand deforming mold defining a mold cavity having an entrance portion arranged to receive the moving strand from the first stage mold, the entrance being of substantially the same cross-section as the first-stage mold and the mold cavity of the deforming mold tapering towards an exit portion thereof in the narrower dimension of its parallelogram cross-section to be of flat planoparallel shape.

2. The continuous casting plant set forth in claim 1, wherein said exit cross-section of said first mold and said entrance cross-section of said second mold are spaced apart to define a space between them and said space is bridged by a strand guide.

3. The continuous casting plant 2 set forth in claim 2, wherein said strand guide consists of two shell parts and is provided with rollers and cooling slots.

4. The continuous casting plant set forth in claim 1, wherein said first-stage mold consists of a traveling plate mold which comprises a pair of opposite, revolving endless plate chains defining between them the mold cavity, said second-stage mold is stationary and comprises two wall portions which constitute continuations of said plate chains and define between them the mold cavity thereof, the wall portions being pivoted on transverse axes in said entrance portion.

5. The continuous casting plant set forth in claim 4, wherein said plate chains comprise successive pairs of mirror-symmetrically arranged plates each having two parts extending at an angle to each other to define parallelogram cross-sections, each of said plates has at one end an edge rib which abuts the other plate of the same pair, each of said wall portions of said second mold is composed of a plurality of longitudinal beams, and further comprising a plurality of actuators operable to move a respective one of said longitudinal beams.

6. The continuous casting plant set forth in claim 5, wherein said actuators are hydraulic actuators.

7. The continuous casting plant set forth in claim 5, wherein each of said beams is provided with a plurality of consecutive rollers and said roller provided on adjacent ones of said beams are staggered.

8. The continuous casting plant set forth in claim 7, wherein said rollers are movably mounted on bearing brackets, which are adjustably mounted on said beams.

9. The continuous casting plant set forth in claim 7, wherein nozzles for discharging a coolant are provided between said beams and said rollers.

10. The continuous casting plant set forth in claim 1, wherein said second mold is succeeded by a pair of transverse squeeze rolls.

* * * * *